US005400507A

United States Patent [19]

Harrison, Jr. et al.

[11] Patent Number: 5,400,507

[45] Date of Patent: Mar. 28, 1995

[54] METHOD OF CHANGING A WORN FRICTIONAL SURFACE OF A ROTATOR DISC

[75] Inventors: Edward F. Harrison, Jr.; J. Bennette Cornwell, III, both of Greenville, S.C.

[73] Assignee: Hurley & Harrison, Inc., Greenville, S.C.

[21] Appl. No.: 273,777

[22] Filed: Jul. 12, 1994

Related U.S. Application Data

[63] Continuation of Ser. No. 966,302, Oct. 26, 1992, abandoned.

[51] Int. Cl.[6] ..... B21B 39/00

[52] U.S. Cl. ..... 29/895.1; 29/402.03; 29/402.08; 29/426.2

[58] Field of Search ..... 29/895.1, 402.08, 402.03, 29/402.01, 426.1, 426.2; 492/28, 45, 48, 56; 57/337, 338, 339, 340, 348, 334

[56] References Cited

U.S. PATENT DOCUMENTS

| | | | |
|---|---|---|---|
| Re. 32,507 | 9/1987 | Schmid et al. . | |
| 3,490,132 | 1/1970 | Kosters et al. | 29/402.08 |
| 3,901,011 | 8/1975 | Schuster . | |
| 4,129,980 | 12/1978 | Dillon . | |
| 4,195,470 | 4/1980 | Sturhahn | 57/337 |
| 4,235,071 | 11/1990 | Dillon . | |
| 4,325,213 | 4/1982 | Adenheuer . | |
| 4,607,484 | 8/1986 | Schuster . | |
| 4,667,464 | 5/1987 | Stahlecker et al. . | |
| 4,676,673 | 6/1987 | Stahlecker et al. . | |
| 4,718,226 | 1/1988 | Schuster et al. | 57/337 |
| 4,991,993 | 2/1991 | Watlington et al. | 29/402.08 |
| 5,224,642 | 7/1993 | Davis et al. | 492/45 |

FOREIGN PATENT DOCUMENTS

| | | | |
|---|---|---|---|
| 2509 | 1/1988 | Japan | 29/895.1 |
| 207412 | 8/1988 | Japan | 29/402.08 |

*Primary Examiner*—Mark Rosenbaum
*Assistant Examiner*—David P. Bryant
*Attorney, Agent, or Firm*—Jeffrey L. Wilson

[57] ABSTRACT

A rotator assembly is provided comprising two disc-shaped base members, each defining central bores therethrough and a disc-shaped middle section defining a central opening therethrough and having a tubular exterior, the middle section matingly fitting between the base members with the tubular exterior extending beyond and overlapping outer edges of the base members while the base members occupy the central opening of the middle section.

16 Claims, 2 Drawing Sheets

METHOD OF CHANGING A WORN FRICTIONAL SURFACE OF A ROTATOR DISC

This application is a continuation of application Ser. No. 07/966,302, filed Oct. 26, 1992, now abandoned.

BACKGROUND OF THE INVENTION

This invention relates generally to the art of textiles, and more particularly to the art of a rotator assembly in the form of disc adaptable for various uses within the textile industry.

U.S. Pat. No. 4,129,980 discloses a friction disc assembly for use in a false twist or friction twist texturing machine of the type wherein a plurality of rotably mounted spindles each carry a plurality of friction discs which overlap and through which a thread is passed along a zig-zag path between the spindles and over the edges of the friction discs. The friction disc assembly is formed of a circular base member extending outwardly from an arbor which is then mounted on one of the spindles. The base member includes an inwardly extending peripheral groove and a separate, ring-shaped friction member formed of a resilient material having a relatively high coefficient of friction and formed of such size and shape as to be releasible snap-fit into the groove. When the ring is worn out, the ring is replaced and the base member is reused.

U.S. Pat. No. 4,607,484 also discloses a friction rotor for the false-twisting of synthetic threads wherein the friction ring of the rotor is comprised of elastic material and is capable of lifting off the rotor upon high rotor rotation speed. At least one annular element is disposed on or in the ring to prevent lift-off, and in one embodiment, the annular element is rigid and is disposed in a groove around the periphery of the ring. In another embodiment, the rigid annular elements are disposed in respective grooves in one or both side faces of the ring. The annular element in another embodiment is disposed inside the ring and may even comprise an initially tensioned spring rather than a rigid annular element.

U.S. Pat. No. 4,676,673 discloses a bearing disk construction for an open end spinning rotor for a spinning unit having a rotor mounted on a rotor shaft, a twin disk bearing arrangement for rotably supporting the rotor shaft and a tangential belt drive engaging the rotor shaft. The bearing disks have a metallic base body and a plastic fitting around the circumference which directly supportingly engages the rotor shaft.

U.S. Pat. No. 4,667,664 discloses a bearing and driving assembly for an open end spinning rotor for a spinning unit having a rotor mounted on a rotor shaft, a twin disk bearing arrangement for rotably supporting the rotor shaft and a tangential belt drive engaging the rotor shaft. The assembly is designed so that the system critical velocity is substantially lower than spinning operational speeds where excessive resonant vibrations may occur.

While the prior art devices function well for their intended purposes, there remains room for improvement within the art of disc assemblies.

SUMMARY OF THE INVENTION

It is thus an object of this invention to provide a novel rotator assembly.

It is another object of this invention to provide such a novel rotator assembly which can be used in a false-twisting apparatus.

It is a still further object of this invention to provide such a novel rotator assembly which includes a middle section for contacting yarn which can be easily removed and replaced when worn out.

These as well as other objects are accomplished by a rotator assembly comprising two disc-shaped base members, each defining central bores therethrough and a disc-shaped middle section defining a central opening therethrough and having a tubular exterior, this middle section matingly fitting between the base members with the tubular exterior extending beyond and overlapping the outer edges of the base members, and the base members contacting one another through the central opening of the middle section.

DETAILED DESCRIPTION

In accordance with this invention it has been found that a novel rotator assembly can be provided. It has also been found that such a novel rotator assembly can be provided for use in a false-twisting apparatus which includes a middle section for contacting yarn moving through the false-twisting apparatus which is easily replaceable when worn out. In the past, much labor was required in replacing a section worn from contact with yarn. During the replacement process, the false-twisting apparatus could not operate. Pursuant to the present invention, however, a section worn from contact with yarn can be removed and replaced with a similar non-worn unit very quickly and easily, thereby reducing the labor and costly down time involved when utilizing prior art sections. The rotator assembly according to this invention is also adaptable for uses other than in false-twisting apparatuses, as will be discussed below.

Figure 1:
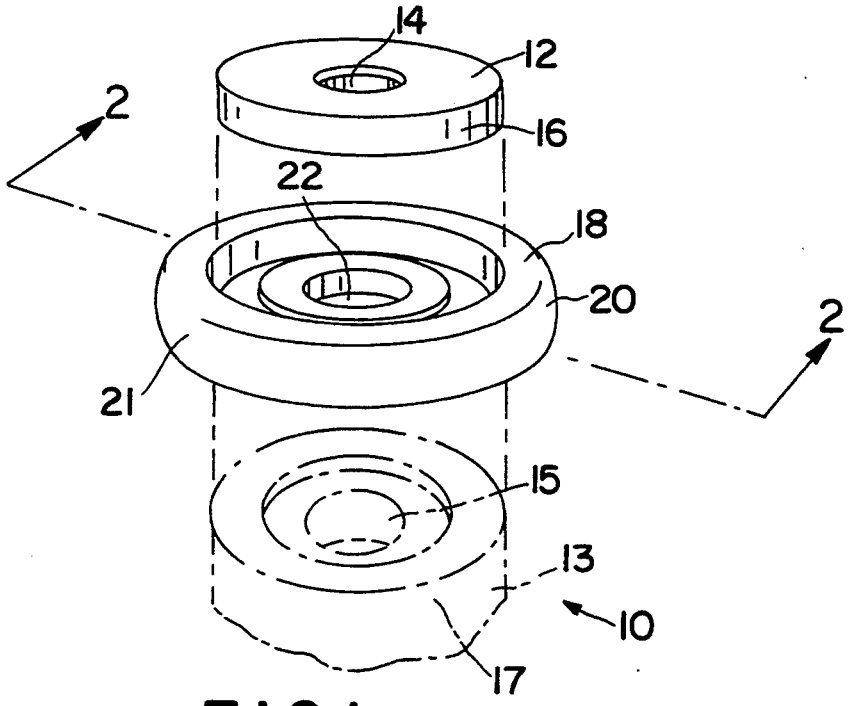
FIG. 1 of the drawings is a perspective view of the rotator assembly according to this invention.

FIG. 1 of the drawings is a perspective view of the rotator assembly 10 according to one embodiment of this invention. The rotator assembly comprises two base members 12 and 13. Each of the base members 12 and 13 is disc-shaped, defines central bores 14 and 15 therethrough and has outer edges 16 and 17 around the perimeter of the disc-shaped base members. Rotator assembly 10 further comprises a disc-shaped middle section 18, only partially visible in FIG. 1, which is designed to fit between base members 12 and 13 in a mating fashion. Middle section 18 defines a central opening 22 therethrough which is occupied by base members 12 and 13. Middle section 18 also has a tubular exterior 20 having an outer substantially frictional surface 21 in the preferred embodiment which is designed for contacting yarn when rotator assembly 10 is used in a false-twisting apparatus.

The tubular exterior 20 of middle section 18 extends beyond and overlaps outer edges 16 and 17 of base members 12 and 13 in the assembled form of rotator assembly 10. Also, base members 12 and 13 contact one another through central opening 22 of middle section 18 in the preferred embodiment.

Figure 2:
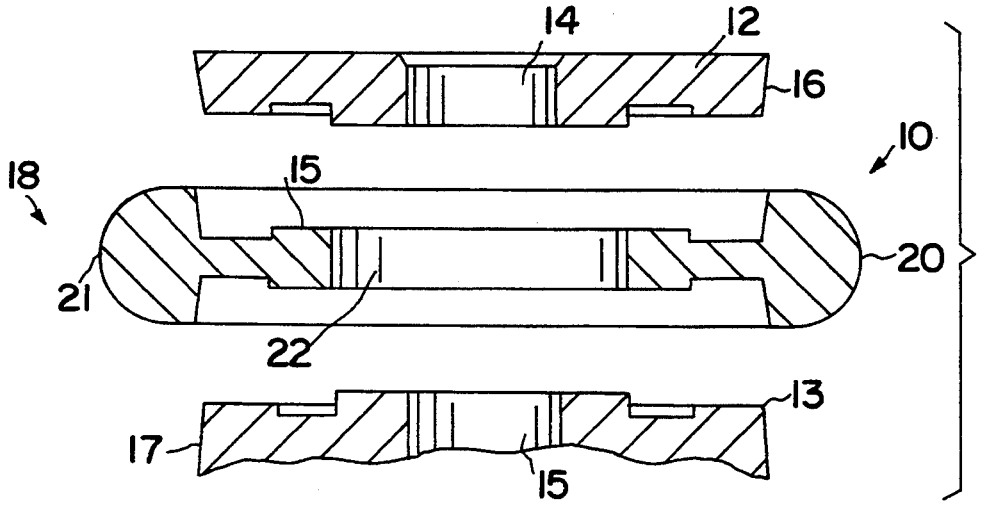
FIG. 2 of the drawings is a cross-section assembly view of the rotator assembly according to this invention.

FIG. 2 of the drawings is a cross-section assembly view of rotator assembly 10 according to this invention. As illustrated, rotator assembly 10 includes two base members 12 and 13 having outer edges 16 and 17 and defining central bores 14 and 15 therethrough. Also included in rotator assembly 10 is middle section 18 defining central opening 22 and having a tubular exterior 20. Middle section 18 is designed to matingly fit between base members 12 and 13 such that tubular exterior 20 of middle section 18 extends beyond and overlaps outer edges 16 and 17 of base members 12 and 13. In the assembled form, base members 12 and 13 contact one another through central opening 22 of middle section 18 in the preferred embodiment. When intended for use in a false-twisting apparatus, rotator assembly 10 preferably includes tubular exterior 20 comprising an outer substantially frictional surface 21 which acts as a bearing surface for contacting the yarn passing through the false-twisting apparatus.

Such a use of a rotator assembly in a false-twisting apparatus frequently causes substantially frictional surface 21 to wear out. Consequently, rotator assembly 10 permits middle section 18 to be easily removed and replaced with a similar non-worn unit.

In the preferred embodiment, base members 12 and 13 and middle section 18 snap fit together in a mating and stable fashion, but base members 12 and 13 can easily unsnap from middle section 18 when pryed apart so that another middle section 18 with an unworn tubular exterior 20 and substantially frictional surface 21 may be placed between the same pair of base members 12 and 13 when an original tubular exterior 20 of a middle section wears out.

This advantageous feature of the present invention provides ease and convenience for replacing a tubular exterior 20 of rotator assembly 10, and furthermore, this feature causes rotator assembly 10 to require only one part of rotator assembly 10 to be replaced when that part is worn out rather than replacing all of rotator assembly 10. The replacement process of this invention is significantly faster than prior art replacement processes and therefore reduces costly down time.

FIGS. 3 through 6, in cross section views, illustrate various alternative embodiments for the structure of a base member to enable the base member to engage and retain a middle section. In each of these embodiments, a single base member is used and is equipped with different types of attaching means for engaging and retaining a middle section.

Figure 3:
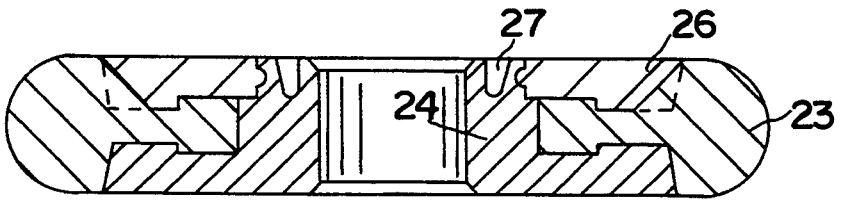
FIG. 3 of the drawings is a cross section view of an alternative embodiment of the rotator assembly.

Referring to FIG. 3, a base member 24 is seen as comprising a retainer 26 which is sufficiently flexible to matingly engage base member 24 and a middle section 23 held therein. In this embodiment, middle section 23 can quickly be removed and replaced by removal and re-insertion of retainer 26. Base member 24 defines a notch 27 so as to allow for easy insertion of retainer 26.

Figure 4:
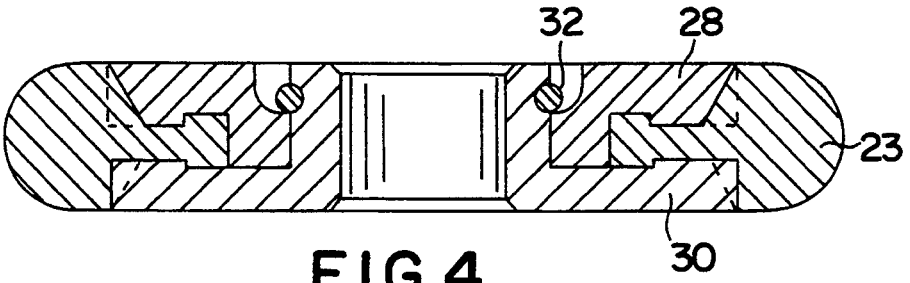
FIG. 4 of the drawings is a cross section view of another alternative embodiment of the rotator assembly.

In FIG. 4, base member 30 is illustrated as comprising a retainer 28 that matingly engages base member 30 and most notably, a split ring 32 is positioned between base member 30 and retainer 28 to provide a hinged attachment for retainer 28. Split ring 32 enables retainer 28 to be hingedly moved out of position without completely removing retainer 28 so that middle section 23 can be replaced.

Figure 5:
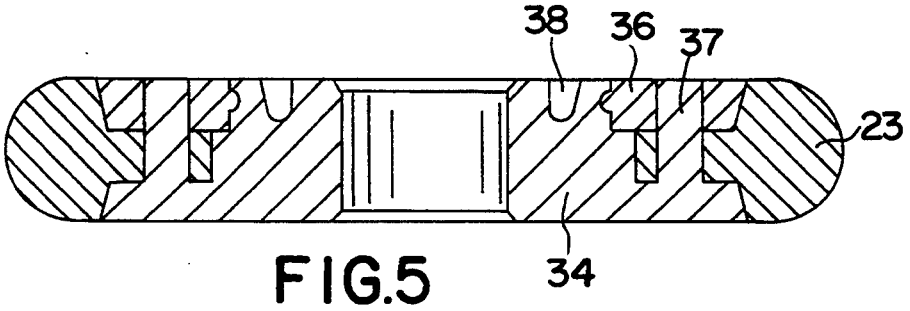
FIG. 5 of the drawings is a cross section view of yet another embodiment of the rotator assembly.

FIG. 5 of the drawings illustrates a base member 34 in another embodiment. Base member 34 comprises a retainer 36 which matingly engages base member 34 and a middle section 23 held therein. As illustrated, base member 34 is similar to base member 24 in FIG. 3, however, base member 34 includes an added area of extension 37 to cooperate with and secure middle section 23. Base member 34 also defines a notch 38 so as to allow for easy insertion of retainer 36.

Figure 6:
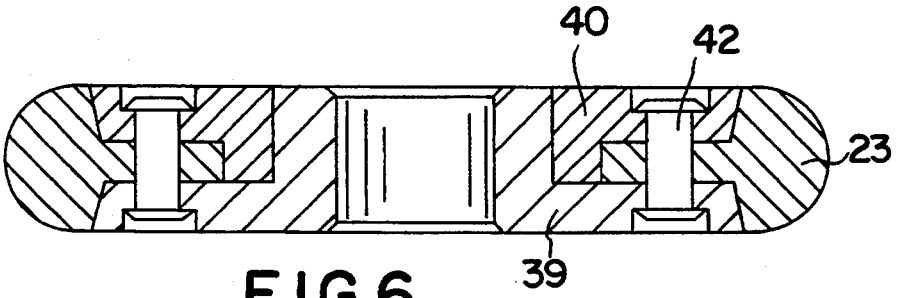
FIG. 6 of the drawings is a cross section view of still another embodiment of the rotator assembly.

FIG. 6 illustrates yet another embodiment, as base member 39 is shown, which comprises a retainer 40 and further includes a rivet 42 to clip middle section 23 and retainer 40 in place. To simply replace middle section 23, rivet 42 is removed which allows removal of retainer 40. Middle section 23 can then be removed and replaced with a non-worn unit and retainer 40 and rivet 42 reattached.

U.S. Pat. Nos. 4,667,464 and 4,676,673 and reissue Pat. No. 32,507 disclose devices adapted for use with an open-end spinning apparatus, and are incorporated herein by reference. The rotator assembly according to this invention has various uses including use as a driving wheel in an open-end spinning apparatus.

It is thus seen that the present invention provides a novel rotator assembly. It is also seen that the present invention provides such a novel rotator assembly for use in a false-twisting apparatus which includes a middle section for contacting yarn which is easily replaceable when worn out. Many variations are apparent to those of skill in the art, and such variations are embodied within the spirit and scope of the present invention as measured by the following appended claims.

That which is claimed:

1. A process for changing a frictional surface of a rotator disc, said process comprising the steps of:

providing a rotator disc comprising:

two disc-shaped base members, each base member defining a central bore therethrough and having an outermost circumferential edge; and a disc-shaped middle section defining a central opening therethrough and having a bulbous circumferential portion with a frictional exterior surface, said middle section matingly fitted between said base members with said bulbous portion extending beyond and overlapping the outermost circumferential edges of said base members, said base members contacting one another through said central opening of said middle section;

removing said base members from said rotator disc to separate said base members from said middle section;

providing a second middle section having a bulbous circumferential portion with a frictional exterior surface; and matingly fitting said second middle section between said base members such that said bulbous portion thereof extends beyond and overlaps the outermost circumferential edges of said base members.

2. The process according to claim 1, further comprising the step of mounting said rotator disc for rotation about a shaft by use of a single fastener.

3. The process according to claim 1, further comprising the step of forming said disc-shaped middle section as a unitary structure and such that said frictional surface is a convex exterior surface.

4. The process according to claim 1, wherein said frictional surface can be changed with minimal deformation thereof.

5. A process for changing a frictional surface of a rotator disc, said process comprising the steps of:

providing a rotator disc comprising:

a disc-shaped base member defining a central bore therethrough and having an outermost circumferential edge;

a disc-shaped middle section defining a central opening therethrough and having a bulbous circumferential portion with a frictional exterior surface, said middle section matingly fitted to said base member with a portion of said base member positioned in said central opening of said middle section; and a retainer having an outermost circumferential edge, said retainer matingly engaging said base member and said middle section such that said base member, said middle section and said retainer together form a disc-shaped assembly with said middle section disposed between said base member and said retainer and with said bulbous portion of said middle section overlapping said outermost circumferential edge of said base member and said outermost circumferential edge of said retainer;

removing said retainer from said assembly;

removing said middle section from said base member;

providing a second middle section with a bulbous circumferential portion and a frictional exterior surface;

fitting said base member into said second middle section; and matingly fitting said second middle section between said retainer and said base member such that said bulbous portion thereof extends beyond and overlaps the outermost edges of said retainer and said base member.

6. The process according to claim 5, further comprising the step of mounting said rotator disc for rotation about a shaft by use of a single fastener.

7. The process according to claim 5, further comprising the step of forming said disc-shaped middle portion as a unitary structure and such that said substantially frictional surface is a convex surface.

8. The process according to claim 5, wherein said frictional surface can be changed with minimal deformation thereof.

9. A process for changing a frictional surface of a rotator disc, said process comprising the steps of:

providing a rotator disc comprising:

a first disc-shaped member defining a central bore therethrough and having an outermost circumferential edge;

a disc-shaped middle section defining a central opening therethrough and having a bulbous circumferential portion with a frictional exterior surface, said middle section matingly fitted to said first disc-shaped member with a portion of said first disc-shaped member positioned in said central opening of said middle section; and a second disc-shaped member defining a central bore therethrough and having an outermost circumferential edge, said second disc-shaped member matingly engaging said first disc-shaped member and said middle section such that said first disc-shaped member, said middle section, and said second disc-shaped member together form a disc-shaped assembly with said middle section disposed between said first and second disc-shaped members and with said bulbous portion of said middle section overlapping said outermost circumferential edge of said first disc-shaped member and said outermost circumferential edge of said second disc-shaped member;

removing said second disc-shaped member from said assembly;

removing said middle section from said first disc-shaped member;

providing a second middle section with a bulbous circumferential portion and a frictional exterior surface;

fitting said first disc-shaped member into said second middle section; and matingly fitting said second middle section between said second disc-shaped member and said first disc-shaped member such that said bulbous portion thereof extends beyond and overlaps the outermost edges of said first and second disc-shaped members.

10. The process according to claim 9, further comprising the step of mounting said rotator disc for rotation about a shaft by use of a single fastener.

11. The process according to claim 9, further comprising the step of forming said disc-shaped middle portion as a unitary structure and such that said substantially frictional surface is a convex surface.

12. The process according to claim 9, wherein said frictional surface can be changed with minimal deformation thereof.

13. A process for changing a frictional surface of a rotator disc, said process comprising the steps of:

providing a rotator disc comprising:

two disc-shaped base members, each base member defining a central bore therethrough and having an outermost circumferential edge; and a disc-shaped middle section defining a central opening therethrough and having a bulbous circumferential portion with a frictional exterior surface, said middle section matingly fitted between said base members with said bulbous portion extending beyond and overlapping said outermost circumferential edges of said base members;

removing said base members from said rotator disc to separate said middle section from said base member;

providing a second middle section with a bulbous circumferential portion and a frictional exterior surface; and matingly fitting said second middle section between said base members such that said bulbous portion thereof extends beyond and overlaps the outermost circumferential edges of said base members.

14. The process according to claim 13, further comprising the step of mounting said rotator disc for rotation about a shaft by use of a single fastener.

15. The process according to claim 13, further comprising the step of forming said disc-shaped middle portion as a unitary structure and such that said substantially frictional surface is a convex surface.

16. The process according to claim 13, wherein said frictional surface can be changed with minimal deformation thereof.

* * * * *